US009426877B2

(12) United States Patent
Tang et al.

(10) Patent No.: US 9,426,877 B2
(45) Date of Patent: Aug. 23, 2016

(54) STANDING WAVE ELECTRON LINEAR ACCELERATOR WITH CONTINUOUSLY ADJUSTABLE ENERGY

(71) Applicants: Tsinghua University, Beijing (CN); Nuctech Company Limited, Beijing (CN)

(72) Inventors: Chuanxiang Tang, Beijing (CN); Zhe Zhang, Beijing (CN); Qingxiu Jin, Beijing (CN); Jiaru Shi, Beijing (CN); Huaibi Chen, Beijing (CN); Wenhui Huang, Beijing (CN); Shuxin Zheng, Beijing (CN); Yaohong Liu, Beijing (CN)

(73) Assignees: Tsinghua University, Beijing (CN); Nuctech Company Limited, Beijing (CN)

( * ) Notice: Subject to any disclaimer, the term of this patent is extended or adjusted under 35 U.S.C. 154(b) by 318 days.

(21) Appl. No.: 14/137,262

(22) Filed: Dec. 20, 2013

(65) Prior Publication Data

US 2014/0185775 A1 Jul. 3, 2014

(30) Foreign Application Priority Data

Dec. 28, 2012 (CN) ..... 2012 1 0586678

(51) Int. Cl.
*H05H 9/04* (2006.01)
*H05G 2/00* (2006.01)
(Continued)

(52) U.S. Cl.
CPC . *H05H 9/04* (2013.01); *H05G 1/32* (2013.01); *H05G 2/00* (2013.01); *H05H 7/12* (2013.01); *H05H 7/22* (2013.01); *H05H 9/048* (2013.01)

(58) Field of Classification Search
CPC ..... H05G 1/32; H05G 2/00; H05H 7/12; H05H 7/22; H05H 9/04; H05H 9/048
See application file for complete search history.

(56) References Cited

U.S. PATENT DOCUMENTS 2,920,228 A 1/1960 Ginzton
3,070,726 A 12/1962 Mallory
(Continued)

FOREIGN PATENT DOCUMENTS

CN 1273761 A 11/2000
CN 2901784 Y 5/2007
(Continued)

OTHER PUBLICATIONS

Nepal et al., "Design study on standing-wave linear accelerator," *Proceedings of the 2001 Particle Accelerator Conference*, Chicago, IL, vol. 4, No. 1, pp. 2802-2804 (2001).
(Continued)

*Primary Examiner* — Glen Kao
*Assistant Examiner* — Chih-Cheng Kao
(74) *Attorney, Agent, or Firm* — Leydig, Voit & Mayer, Ltd.

(57) ABSTRACT

A standing wave electron linear accelerating apparatus and a method thereof are disclosed. The apparatus comprises an electron gun configured to generate electron beams; a pulse power source configured to provide a primary pulse power signal; a power divider coupled downstream from the pulse power source and configured to divide the primary pulse power signal outputted from the pulse power source into a first pulse power signal and a second pulse power signal; a first accelerating tube configured to accelerating the electron beams with the first pulse power signal; a second accelerating tube configured to accelerate the electron beams with the second pulse power signal; a phase shifter configured to continuously adjust a phase difference between the first pulse power signal and the second pulse power signal so as to generate accelerated electron beams with continuously adjustable energy at output of the second accelerating tube.

17 Claims, 5 Drawing Sheets

(51) Int. Cl.

| | |
|---|---|
| ***H05H 7/12*** | (2006.01) |
| ***H05H 7/22*** | (2006.01) |
| ***H05G 1/32*** | (2006.01) |

(56) References Cited

U.S. PATENT DOCUMENTS

| | | | |
|---|---|---|---|
| 3,843,902 | A | 10/1974 | Miram et al. |
| 4,024,426 | A | 5/1977 | Vaguine |
| 4,118,653 | A | 10/1978 | Vaguine |
| 4,286,192 | A | 8/1981 | Tanabe et al. |
| 4,382,208 | A | 5/1983 | Meddaugh et al. |
| 5,744,919 | A | 4/1998 | Mishin et al. |
| 6,376,990 | B1 | 4/2002 | Allen et al. |
| 7,302,044 | B2 | 11/2007 | Gabioud |
| 7,432,672 | B2 | 10/2008 | Meddaugh et al. |
| 2007/0046401 | A1 | 3/2007 | Meddaugh |
| 2007/0064873 | A1 | 3/2007 | Gabioud |
| 2007/0236300 | A1 | 10/2007 | Meddaugh et al. |
| 2009/0302785 | A1 | 12/2009 | Miller et al. |

FOREIGN PATENT DOCUMENTS

| | | | |
|---|---|---|---|
| CN | 1997260 | A | 7/2007 |
| CN | 202019491 | U | 10/2011 |
| CN | 203233589 | U | 10/2013 |
| FR | 2 856 513 | A1 | 12/2004 |
| JP | 2008-218053 | A | 9/2008 |
| WO | WO 2011/109668 | A2 | 9/2011 |

OTHER PUBLICATIONS

Tsai et al., "RF Rescue Options for TPS Linac," *Proceedings of IPAC2012*, New Orleans, LA, pp. 1668-1670 (2012). http://accelconf.web.cern.ch/AccelConf/IPAC2012/papers/tuppp026.pdf.

European Patent Office, Extended European Search Report in European Patent Application No. 13198316.5 (Apr. 14, 2014).

Knapp et al., "Standing Wave High Energy Linear Accelerator Structures," *Review of Scientific Instruments*, vol. 39, No. 7, pp. 979-991 (1968).

European Patent Office, Communication Pursuant to 94(3) EPC in European Patent Application No. 13 198 316.5 (Jul. 28, 2015).

Federal Service for Intellectual Property (Rospatent), Office Action in Russian Patent Application No. 2013156267/07 (087 725) (Feb. 3, 2015).

Federal Service for Intellectual Property (Rospatent), Office Action in Russian Patent Application No. 2013156267/07 (087 725) (May 7, 2015).

Federal Service for Intellectual Property (Rospatent), Office Action in Russian Patent Application No. 2013156267/07 (087 725) (Aug. 25, 2015).

Japanese Patent Office, Notification of Reasons for Refusal in Japanese Patent Application No. 2013-264518 (Nov. 25, 2014).

Korean Intellectual Property Office, Office Action in Korean Patent Application No. 10-2013-0161885 (Sep. 30, 2014).

Korean Intellectual Property Office, Office Action in Korean Patent Application No. 10-2013-0161885 (Apr. 29, 2015).

State Intellectual Property Office of the People's Republic of China, First Office Action in Chinese Patent Application No. 201210586678.3 (Oct. 8, 2015).

STANDING WAVE ELECTRON LINEAR ACCELERATOR WITH CONTINUOUSLY ADJUSTABLE ENERGY

TECHNICAL FIELD

The embodiments of the present disclosure generally relate to standing wave electron linear accelerator technique, and more particularly, to medical imaging and radiation techniques using an accelerator as a radiation source.

BACKGROUND

Modern medicine uses X-rays more and more widely for diagnosing and treatment. In a modern medical imaging system, an X-ray tube is typically used to generate X-rays with energy lower than 500 keV (herein, energy refers to the energy of an electron beam before it hits a target), and a low-energy electron linear accelerator is used to generate X-rays with energy higher than 2 MeV. However, X-ray sources for X-rays with energy falling within a range from 0.5 MeV to 2 MeV are less common (there is a kind of X-ray tube for X-rays with an energy of 600 KeV, but such a device can be very expensive). The reason is that in this energy range, the X-ray tube is exploited to the limit, resulting in a high cost of production as the energy of the X-rays increases. An electron linear accelerator does not provide a practical solution as it is relatively expensive compared to an X-ray tube, and because an accelerator usually can only provide X-rays of a single energy. Yet X-rays with an energy falling within the range from 0.5 MeV to 2 MeV play an important role in medical imaging.

The Z value (average atomic number) of a target of medical imaging (e.g., an organism) is usually about 10. In such case, in order to ensure good imaging quality, the Compton scattering that occurs when photons interact with the target needs to be limited. The Compton scattering effect dominates when the incident photons have high energy, which will result in degradation of imaging quality. Therefore, it is considered that X-rays with an energy of about 0.6 MeV, which falls just within the foregoing range, can obtain comparatively superior imaging quality. Furthermore, imaging quality varies depending on the Z value of the target of the medical imaging. Medical imaging therefore typically requires X-rays with an energy falling within the range from 0.5 MeV to 2 MeV.

An accelerator with continuously adjustable energy can be used as an alternative to X-ray tubes, which generally do not work for the desired medical imaging energy range. There are currently several approaches for continuously adjusting energy of the accelerator. One way is to change the power fed from a power source to change the accelerating gradient of the accelerator so as to change the energy gain. This approach has a disadvantage in that the change during the low-energy phase of the gradient of the accelerating tube increases energy dispersion, and thus degrades the quality of beams. In order to address the problem of a large energy dispersion, U.S. Pat. Nos. 2,920,228 and 3,070,726 disclose an accelerator that uses two traveling wave tubes to accelerate electrons. The first traveling wave tube accelerates electrons to near the speed of light, and the second adjusts the energy by changing the RF (Radio Frequency) phase. The approach, however, has a disadvantage in that the acceleration efficiency is low due to a traveling wave accelerating structure. In order to address the problem of low efficiency, U.S. Pat. No. 4,118,653 proposes an accelerating structure by combining traveling waves and standing waves. The approach, however, has a disadvantage in that two kinds of acceleration structures are used, which results in a decentralized structure and complex peripheral circuitries. In order to have a compact acceleration structure, U.S. Pat. No. 4,024,426 proposes a standing wave accelerator using two interlaced, side-coupled substructures which adjusts the energy by changing a microwave phase difference between accelerating tubes. The approach has a disadvantage in that the accelerating tube has a complex structure that is difficult to manufacture, rendering the approach difficult to implement. In order to achieve a simple acceleration structure and a high accelerating efficiency, U.S. Pat. Nos. 4,286,192 and 4,382,208 propose an accelerator, which adds several (one or two, respectively) perturbation sticks on a coupling cavity of a side-coupled linear accelerator, the perturbation stick adjusting the phase by adjusting its insertion depth. The approach has a disadvantage in that the range for adjusting the energy is small and requires an expert to adjust the perturbation stick. In view of the foregoing disadvantages, Chinese Patent No. CN202019491U discloses a side-coupled standing wave accelerator that adjusts the energy by adjusting the accelerating gradient of two segments of accelerating tubes, respectively. But this approach too has a disadvantage in that the accelerator has a large width, the microware feeding system is complex, and it cannot provide electron beams of low energy (~1 MeV).

In view of the foregoing, existing X-ray tubes and linear accelerators cannot cover the energy range from 0.5 MeV to 2 MeV, or have a complicated structure and are difficult to implement. Therefore, there is a need for an accelerating apparatus that outputs beams that cover the desired energy range, has a simple structure, and is easy to implement with a tolerable cost.

SUMMARY

An aspect of the present invention is to provide a standing wave electron linear accelerating apparatus that outputs electrons having an energy that is continuously adjustable and covers a predetermined energy range.

In an embodiment, there is provided a standing wave electron linear accelerating apparatus comprising an electron gun configured to generate electron beams; a pulse power source configured to provide a primary pulse power signal; a power divider coupled downstream from the pulse power source and configured to divide the primary pulse power signal outputted from the pulse power source into a first pulse power signal and a second pulse power signal; a first accelerating tube arranged downstream from the electron gun, coupled to the power divider and configured to accelerate the electron beams using the first pulse power signal; a second accelerating tube arranged downstream from the first accelerating tube and configured to receive the second pulse power signal from the power divider and accelerate the electron beams received from the first accelerating tube with the second pulse power signal; and a phase shifter coupled to an output of the power divider and configured to continuously adjust a phase difference between the first pulse power signal and the second pulse power signal to generate accelerated electron beams with continuously adjustable energy at an output of the second accelerating tube.

In another embodiment, there is provided a standing wave electron linear accelerating apparatus comprising an electron gun configured to generate electron beams; a first pulse power source configured to provide a first pulse power signal; a second pulse power source configured to provide a second pulse power signal; a first accelerating tube arranged downstream from the electron gun, coupled to the first pulse power source and configured to accelerate the electron beams with the first pulse power signal; a second accelerating tube arranged downstream from the first accelerating tube and configured to receive the second pulse power signal from the second pulse power source and accelerate the electron beams received from the first accelerating tube using the second pulse power signal; and a phase shifter coupled to an output of the first pulse power source and/or an output of the second pulse power source and configured to continuously adjust a phase difference between the first pulse power signal and the second pulse power signal to generate accelerated electron beams with continuously adjustable energy at an output of the second accelerating tube.

According to another embodiment, there is provided a method for use of a standing wave electron linear accelerating apparatus comprising the steps of generating electron beams; accelerating the electron beams using a first pulse power signal in a first accelerating tube; accelerating the electron beams using a second pulse power signal in a second accelerating tube that is arranged downstream from the first accelerating tube; continuously adjusting a phase difference between the first pulse power signal and the second pulse power signal to generate accelerated electron beams with continuously adjustable energy at the output of the second accelerating tube.

Embodiments of the standing wave electron linear accelerating apparatus further comprise a target arranged downstream from the second accelerating tube and configured to be hit by the accelerated electron beams to generate X-rays.

Embodiments of the standing wave electron linear accelerating apparatus further comprise an attenuator coupled to the phase shifter and configured to attenuate the first pulse power signal and/or the second pulse power signal.

According to embodiments of the invention, the phase shifter is configured to adjust the phase difference so that accelerating cavities of the first accelerating tube and the second accelerating tube each operate in an accelerating phase mode.

According to embodiments of the invention, the phase shifter is configured to adjust the phase difference so that an accelerating cavity of the first accelerating tube operates in an accelerating phase mode while an accelerating cavity of the second accelerating tube operates in a decelerating phase mode.

According to embodiments of the invention, in each of the first accelerating tube and the second accelerating tube, magnetic coupling occurs between accelerating cavities, and there is a coupling hole at a place in the accelerating cavities where a magnetic field of a wall of the cavities is relatively large.

According to embodiments of the invention, the standing wave electron linear accelerating apparatus further comprises a power coupler arranged between the first accelerating tube and the second accelerating tube and configured to supply power to the first accelerating tube and the second accelerating tube.

According to embodiments of the invention, the electron gun injects electrons into the first accelerating tube at a negative angle.

According to embodiments of the invention, the target is mounted on a rotatable base so that an angle of an incident direction of the accelerated electron beams with respect to a surface of the target varies with the energy of the electron beams.

According to embodiments of the invention, the target is mounted in a vacuum box which is fixed on a rotatable base. The side of the vacuum box includes an X-ray window and the second accelerating tube is coupled to the vacuum box via a corrugated pipe.

According to embodiments of the invention, the accelerated electron beams have an energy within a range of 0.5 MeV to 2.00 MeV.

According to embodiments of the invention, the standing electron linear accelerating apparatus is continuously adjusted within a predetermined energy range by adjusting the phase difference between the first accelerating segment and the second accelerating segment.

Furthermore, according to embodiments of the invention, on-axis magnetic coupling occurs between cavities of the two accelerating tubes, rather than side coupling commonly used in a standing wave linear accelerator, and thereby the width of the accelerating tube is reduced.

Furthermore, according to embodiments of the invention, the accelerating tube is of a single-periodic structure so that the coupling cavity is not required. The wall of the cavity is thickened and thus the cavities are easy to manufacture.

Furthermore, according to embodiments of the invention, the two segments of the accelerating tubes both operate in a $\pi$ mode, and thus the accelerating efficiency is highest. At the same time, the number of cavities is small due to the application of low-energy beams, the mode spacing is large enough to secure stable operation of the accelerating system, and the accelerating system is more compact in the vertical direction.

Furthermore, according to embodiments of the invention, the accelerating tube uses an RF alternating phase focusing technique, which automatically and laterally focuses the electron beam bunches using a microwave field in the accelerating tubes and thus the spot at the output of the accelerating system is sufficiently small (such as, having a root mean square radius of 0.5 mm), to produce a high imaging quality. At the same time, the focusing coil is not required, which further reduces the width of the accelerating tube.

Furthermore, according to embodiments of the invention, in order to further enhance the power and quality of X-rays outputted from the apparatus, the structure of the target is redesigned by providing it with a rotation mechanism by using a corrugated pipe and a rotatable base, and thus X-rays of the maximal power can be outputted for electron beams of any energy.

BRIEF DESCRIPTION OF THE DRAWINGS

These and/or other aspects will become more apparent and more readily appreciated from the following description of the embodiments taken in conjunction with the accompanying drawings, in which.

DETAILED DESCRIPTION OF THE EMBODIMENTS

Figure 1:
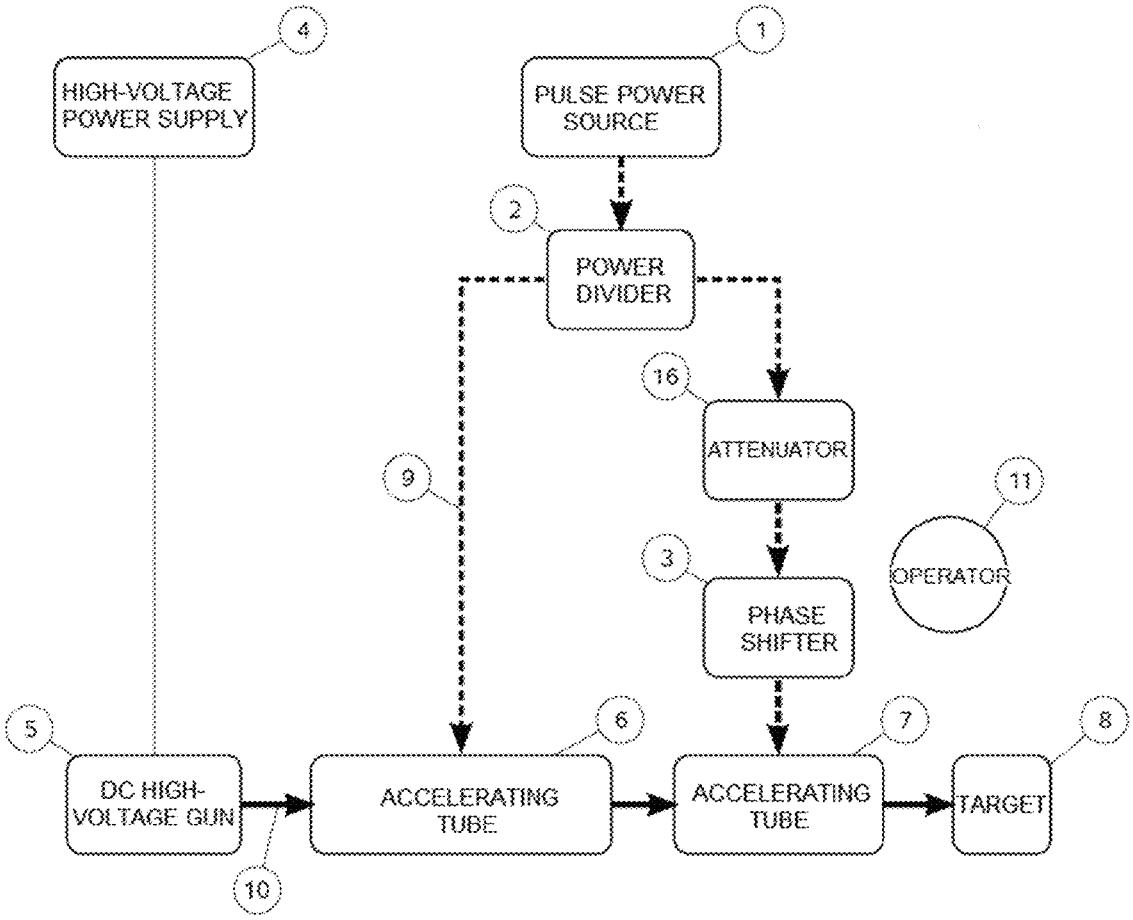
FIG. 1 illustrates a schematic diagram of a standing wave electron linear accelerating apparatus.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description.

In view of the disadvantages of the prior art that an electron linear accelerator cannot be continuously adjusted in a predetermined energy range (for example, the energy range from 0.5 MeV to 2.0 MeV), embodiments of the present invention provide a standing wave electron linear accelerating apparatus. In the apparatus, electron beams generated from an electron gun are accelerated by a cascaded first accelerating tube and second accelerating tube. A first pulse power signal and a second pulse power signal are provided for respective first accelerating tube and second accelerating tube for the accelerating operations. Moreover, the apparatus comprises a phase shifter that continuously adjusts a phase difference between the first pulse power signal and the second pulse power signal so as to generate accelerated electron beams with continuously adjustable energy at an output of the second accelerating tube.

In an embodiment, the standing wave electron linear accelerating apparatus may use one and the same pulse power source. In such case, the power of microwaves outputted from the power source is divided into two branches in a power divider, the first branch supplying power to a first segment of the accelerating tube, converging and accelerating the continuous electron beams emitted from the direct-current high-voltage gun to a first high energy (for example, 1.25 MeV). The first segment of the accelerating tube constitutes a combined accelerating tube together with a second segment of the accelerating tube and a drift segment that connects the first and second segments. The second branch is attenuated by an attenuator, and passes through a phase shifter which can be adjusted up to 360° in phase, and supplies power to the second segment of the accelerating tube of the combined accelerating tube. When the phase shifter is adjusted to have an appropriate phase shift $\phi$, the second segment of the accelerating tube is in phase with the first segment of the accelerating tube, and the electron beams outputted from the first segment of accelerating tube can be accelerated to the maximal energy, i.e., a second high energy (for example, 2.00 MeV). When the phase shift of the phase shifter is adjusted to be about $180°+\phi$, the second segment of the accelerating tube is in opposite phase with the first segment of the accelerating tube, and the electron beams outputted from the first segment of the accelerating tube can be decelerated to the minimal energy (for example, 0.50 MeV). When the phase shift of the phase shifter changes continuously from $\phi$ to $180°+\phi$, the electron beams at the output of the second segment of the accelerating tube have an energy that continuously varies from the second high energy (for example, 2.00 MeV) to the minimal energy (for example, 0.50 MeV).

According to embodiments, a rotatable target may be provided. By appropriately rotating the target and a window therein horizontally, the electron beams of any energy may generate X-rays of a maximal output power after striking the target.

FIG. 1 illustrates a schematic diagram of a standing wave electron linear accelerating apparatus. As shown in FIG. 1, the standing wave electron linear accelerating apparatus with continuously adjustable energy involved in the present invention comprises a microwave power system (including pulse power source 1, power divider 2, phase shifter 3, attenuator 16,=and the waveguide and coupler 12 shown in FIG. 2), an electron gun power system (including high-voltage power supply 4 and transmission lines), direct-current high-voltage electron gun 5, a combined accelerating tube (including accelerating tube 6, accelerating tube 7, and drift segment 15 connecting the two accelerating tubes as shown in FIG. 2) and a rotatable target structure (including target 8, corrugated pipe 17 shown in FIG. 6, vacuum box 18, X-ray window 19 and rotatable base 20).

Figure 2:
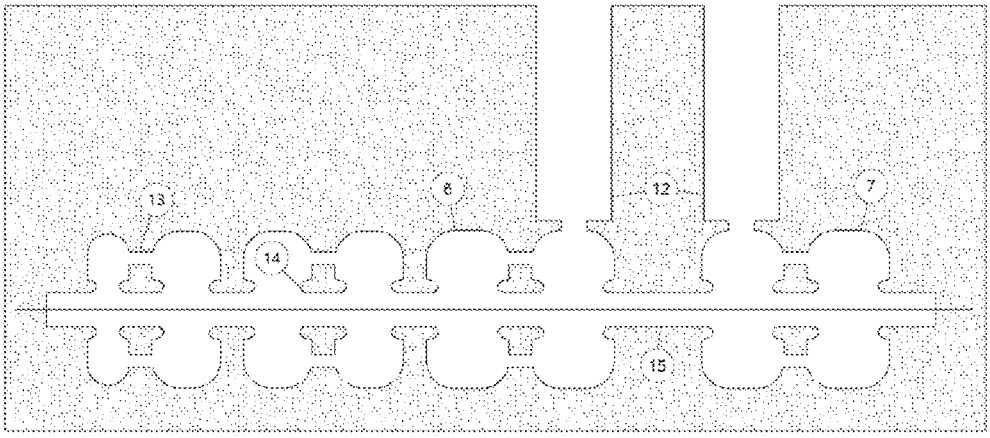
FIG. 2 illustrates a schematic diagram of an accelerating tube and a coupler in a standing wave electron linear accelerating apparatus.
Figure 6:
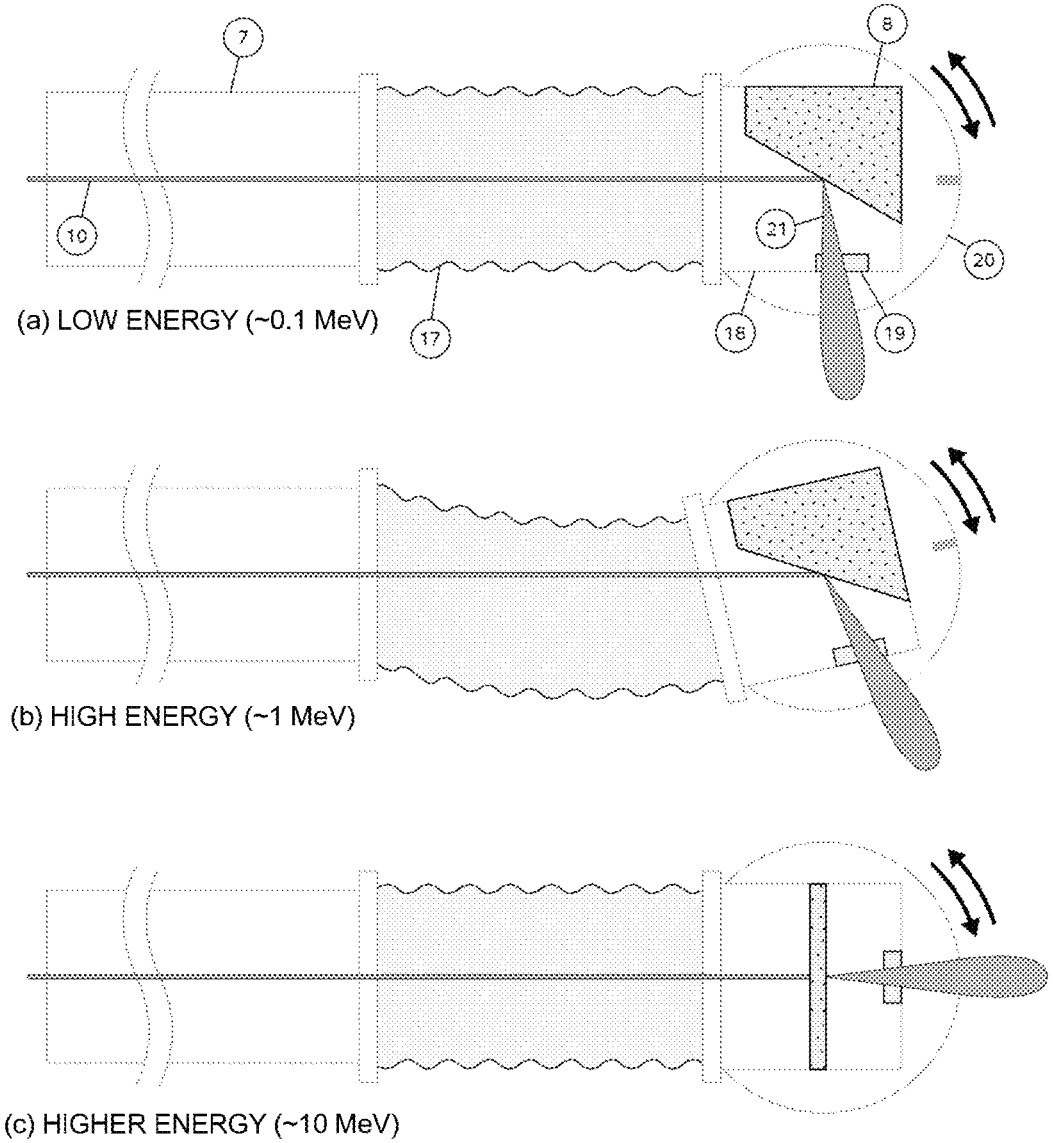
FIG. 6 illustrates a structure and operating principle of a target in a standing wave electron linear accelerating apparatus.

When the apparatus operates, pulse power source 1 (typically, a magnetron) outputs microwave power 9, which is divided into two branches in power divider 2, one branch passing through directly power coupler 12 (at the left) shown in FIG. 2 and feeding into accelerating tube 6, the other branch being attenuated in attenuator 16 and having phase shifted in phase shifter 3 and then establishing an accelerating field of TM010 mode. At the same time, high-voltage power supply 4 is triggered to supply power to direct-current high-voltage gun 5, which emits electron beams 10. The electron beams 10 form a sequence of electron beam bunches with beam bunches spaced vertically by one microwave length, after being converged and accelerated in accelerating tube 6 (for X band, the spacing is 3.22 cm). Operator 11 changes the phase shift of phase shifter 3 (i.e., changes the phase difference between accelerating tube 6 and accelerating tube 7) in real time. The electron beam bunches will have different final energies after passing through accelerating tube 7, and thus will obtain X-rays of different energies after hitting target 8. Since the phase shift of phase shifter 3 can be adjusted continuously, the energy of X-rays can also change continuously. X-rays generated by electrons of different energies striking the target have different power angle distribution. The angle at which X-rays of the maximal power are outputted can be matched by rotating base 20 on which target 8 is fixed (as shown in FIG. 6).

Figure 3:
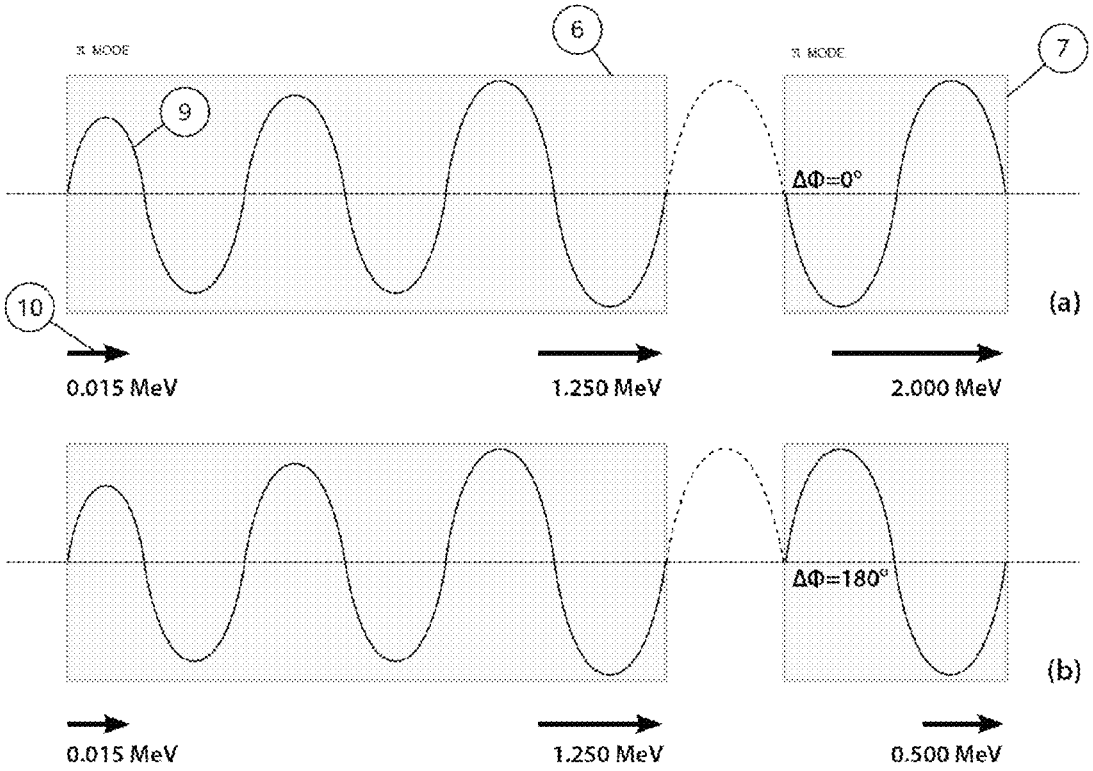
FIG. 3 illustrates the relationship between phases of a first accelerating tube and a second accelerating tube in a standing wave electron linear accelerating apparatus.

Some description is given before describing the principle of changing the energy of the electron beam bunch by adjusting the phase difference between two segments of the accelerating tubes. The distribution of the accelerating field at the axis of accelerating tubes 6 and 7 along the axis is shown in FIG. 3 by the black solid line, where a portion between two adjacent zero points represents one cavity. It can be seen from FIG. 2 that accelerating tube 6 comprises six cavities and accelerating tube 7 comprises two cavities, and the respective field distributions of the cavities can be found in FIG. 3. In order to maximize the acceleration efficiency, the two segments of accelerating tubes each operate in a $\pi$ mode, where the microwave phase difference between two adjacent cavities is 180°. Accordingly, the accelerating field is distributed with alternating positive and negative values, as shown in FIG. 3. As can be seen from FIGS. 2 and 3, the lengths of cavities gradually increase due to the relative speed $\beta$ increasing during the acceleration of electrons. The lengths of the accelerating cavities will increase with the relative speed $\beta$ of electrons to ensure that electrons will always be subjected to an accelerating phase throughout their movement in the accelerating tubes. In one embodiment, the maximal acceleration energy of accelerating tube 6 is 1.25 MeV, while the maximal acceleration energy of accelerating tube 7 is 0.75 MeV.

The principle of changing energy of electron beam bunches by adjusting a phase difference between two segments of accelerating tubes will be described in conjunction with FIGS. 2-3 below. When electron beams 10 enter accelerating tube 6, the energy is 15 keV (the initial energy of the electron beams supplied from direct-current high-press cavity 5). After they are captured and accelerated by accelerating tube 6, a sequence of electron beam bunches with energy of 1.25 MeV will be formed at the output of accelerating tube 6. At that time, if the phase shift of the phase shifter causes the microwave field in accelerating tube 7 to match the condition that the whole combined cavity operates in $\pi$ mode as shown in FIG. 3(*a*) (it shall be noted that the dotted line in the figure is not a real field, and is illustrated as an auxiliary field for facilitating understanding), the electron beam bunches will be subjected to an accelerating phase throughout accelerating tube 7 after they have drifted over drift segment 15, and their energy will be increased by 0.75 MeV to the maximal energy 2.00 MeV. Otherwise, if the phase shift of phase shifter causes accelerating tube 7 to have a phase opposite to the case shown in FIG. 3(*a*), which is shown in FIG. 3(*b*), the electron beam bunches will be subjected to a decelerating phase throughout accelerating tube 7 after they have drifted over drift segment 15, and their energy will be decreased by 0.75 MeV to the minimal energy 0.50 MeV. If the amount of phase shift of phase shifter 3 is adjusted, the electron beam bunches will be subjected to an accelerating phase for a period and subjected to a decelerating phase for another period during their movement in accelerating tube 7, the energy gained in accelerating tube 7 will be in the range from 0.75 MeV to −0.75 MeV, and thus electron beam bunches of energy covering the range from 0.50 MeV to 2.00 MeV will be obtained at the output of the apparatus.

The final energy of the electron beam bunches may be expressed by $$E=E1+E2\cos(\Delta\phi) \quad (1)$$

wherein E=the final energy of the electron beam bunches (MeV); E1=the maximal accelerating energy in the first segment of accelerating tube (MeV); E2=the maximal accelerating energy in the second segment of accelerating tube (MeV); and $\Delta\phi$=a relative (to the phase shift for the maximal accelerating energy) phase shift of the phase shifter (deg). In one embodiment, E1=1.25 MeV, E2=0.75 MeV, and thus the final energy will vary in the range from 0.50 MeV to 2.00 MeV.

In order to compact the structure of the accelerating tube, a magnetic coupling is utilized between the accelerating cavities (see FIG. 2), and a coupling hole 13 is open at a place in the accelerating cavity where the magnetic field of the wall of the cavities is relatively large. FIG. 2 illustrates a cross section of the combined accelerating tube, and shows only the coupling holes between the odd-numbered cavities and their adjacent cavities on the right. The coupling holes between the even-numbered cavities and their adjacent cavities on the right are open at a place where it is 90° relative to the place of coupling hole 13 laterally, so as to avoid the possible generation of a dipole mode in the cavities (which otherwise will deflect the electron beams). Drift segment 15 removes the coupling between accelerating tubes 6 and 7, so that the phase difference between the two tubes can be freely adjusted. Power coupler 12 individually provides power to the two segments of accelerating tubes respectively. The accelerating tubes raise nose structure 14 to increase the transition time factor, and thereby enhance the effective shunt impedance.

Figure 4A:
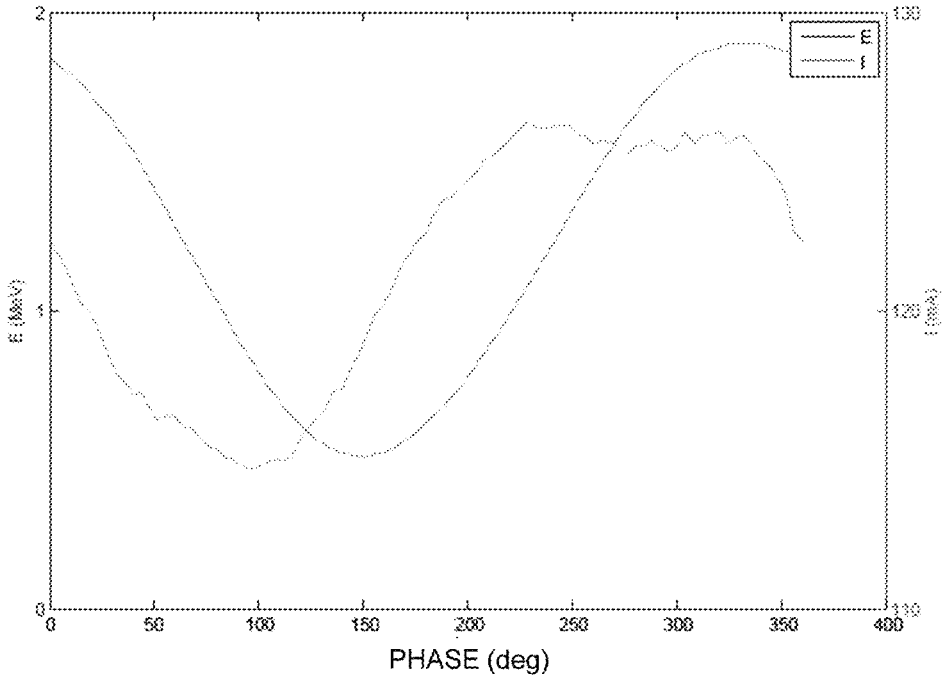
FIG. 4A illustrates the relationship between variations of energy and of intensity of beams in a standing wave electron linear accelerating apparatus.
Figure 4B:
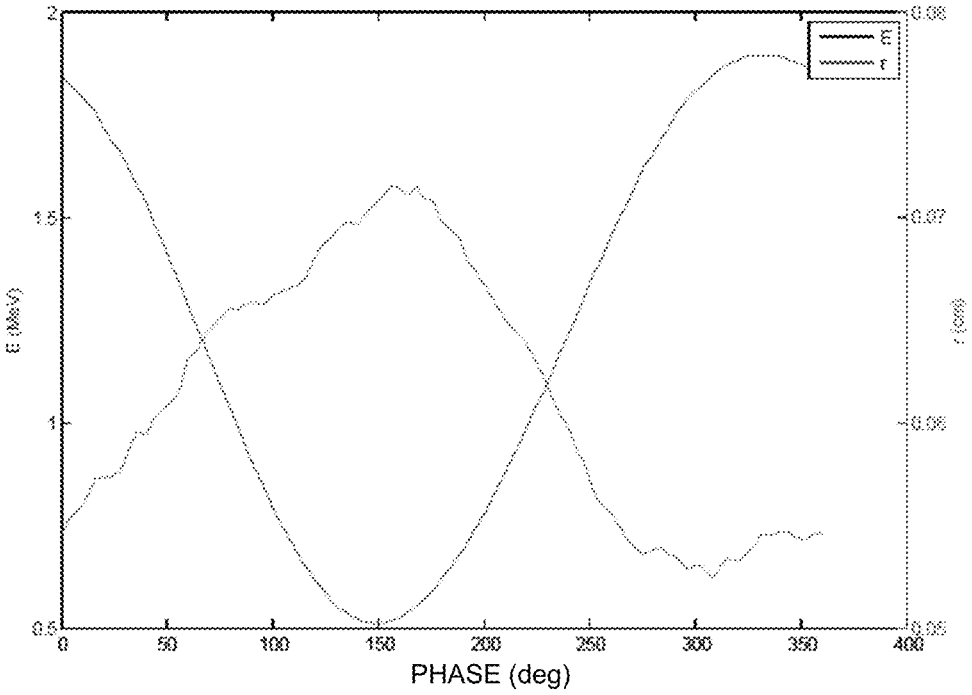
FIG. 4B illustrates the energy and radius varying according to a phase difference in a standing wave electron linear accelerating apparatus.

FIGS. 4A and 4B show important parameters of the electron beam bunches at the output of the apparatus, including curves of average energy E, maximal intensity I of the beams and root mean square radius rrms versus the relative phase shift $\Delta\phi$. It can be seen from the drawings that the variation of the average energy matches the cosine relationship expressed in formula 1. The other parameters vary stably, which means that the apparatus of the present invention is capable of providing electron beam bunches of continuously adjustable energy that have stable parameters and can meet the requirement of medical imaging.

Figure 5:
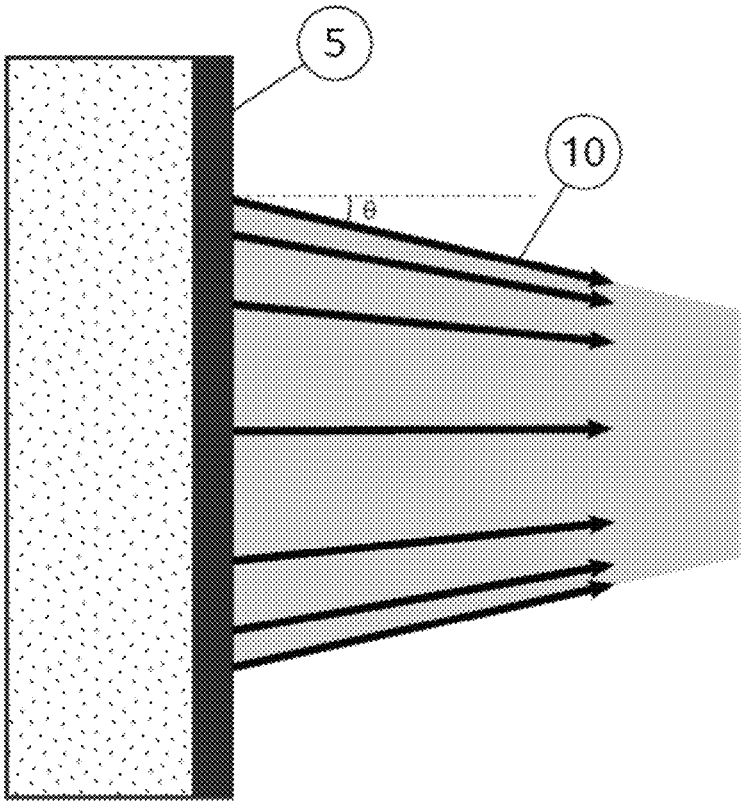
FIG. 5 illustrates the manner of injection of a direct-current high-voltage electron gun in a standing wave electron linear accelerating apparatus.

In order to ensure that the spot at the output of the apparatus is sufficiently small, direct-current high-voltage gun 5 injects electron beams 10 in a special injection manner, i.e., a negative angle injection. FIG. 5 illustrates the visual interpretation of the negative angle injection. That is, the envelope of the electron beams has a negative envelope angle at the injection, so that the electron beams will have a better transverse focusing in accelerating tube 6 to reduce the size of the spot at output of the apparatus. At the same time, utilization of a negative angle injection also can enhance a capture ratio of the apparatus, and thus a stream of higher energy can be obtained at output of the apparatus.

Since X-rays generated by electron beams of different energies striking the target have different power angle distribution (in the case that electron beams of higher energy strike a reflection target, the power is substantially focused on the movement direction of the electron beams; in the case that electron beams of lower energy strike a reflection target, the power is substantially focused on a direction perpendicular to the movement direction of the electron beams), the output direction of X-rays generated by electrons striking the target should be adjusted in synchronization to the adjustment of the energy of the electron beams so that X-rays of the maximal energy can be outputted all the time. The present disclosure redesigns the structure of the target to reach the requirement.

The structure of the target and the principle of outputting X-rays of a maximal power will be described below in details. As shown in FIG. 6, accelerating tube 7 is coupled to vacuum box 18 via corrugated pipe 17 (the object of using a corrugated pipe is to ensure that the vacuum box can rotate horizontally in a predetermined angle range while the apparatus is sealed in a vacuum), and target 8 is placed within vacuum box 18 which is fixed to rotatable base 20. X-ray window 19 is installed on the wall of the vacuum box. In order to ensure the longevity of the target and the quality of the electron beams, the whole system (including the accelerating tubes, the corrugated pipe and the vacuum box) is vacuumed. When the system operates, electron beams 10 are accelerated by accelerating tube 7 and then enter corrugated pipe 17, and drift therein. After that, the electron beams enter vacuum box 18 and strike target 8 to generate X-rays 21. X-rays 21 output from X-ray window 19 on the wall of the vacuum box, and can be collected and utilized by subsequent imaging systems. If the energy of electron beams is not high (~450 keV), base 20 is positioned at a small angle, as shown in FIG. 6(*a*). In such case, X-rays about the angle of the maximal power are outputted from X-ray window 19. If the energy of electron beams is enhanced (~1 MeV), the angle between the direction of the maximal power and the movement direction of electron beams decreases, and thus X-rays of the maximal power cannot be outputted from the original X-ray window. In such case, base 20 is rotated to rotate the angles of target 8 and of X-ray window 19. By appropriate adjustment, the X-ray window 19 can output X-rays of the maximal power again, as shown in FIG. 6(*b*). Although the energy range of the electron beams in the embodiments is shown to be from 0.5 MeV to 2.00 MeV, the target structure designed according to the present disclosure can work even if the electron beams have a higher energy (~10 MeV), as shown in FIG. 6(*c*). In such case, the reflection target is replaced with a transmission target and X-ray window 19 is placed on the back wall of the vacuum box.

According to embodiments of the invention, there is provided a standing wave electron linear accelerating apparatus having continuously adjustable energy. In the apparatus, an energy of electron beams is continuously adjusted by adjusting a phase difference between accelerating tubes, and thus the spot of the beams is stable. Furthermore, the accelerating tube has a single-cycle structure, and operates in a π mode, and thus the accelerating efficiency is high. Moreover, a rotatable target structure is utilized, and thus X-rays of the maximal power can be outputted during the change of the energy of the electron beams that strike the target.

According to other embodiments of the invention, there is also provided a method for use of a standing wave electron linear accelerating apparatus having continuously adjustable energy, comprising generating electron beams, and then accelerating the electron beams using a first pulse power signal in a first accelerating tube. After that, in a second accelerating tube downstream from the first accelerating tube, the electron beams are accelerated using a second pulse power signal. Finally, a phase difference between the first pulse power signal and the second pulse signal is continuously adjusted, so as to generate accelerated electron beams with continuously adjustable energy at the output of the second accelerating tube.

In particular, the apparatus comprises a combined accelerating tube which is comprised of two segments of standing wave accelerating tubes 6, 7 and drift segment 15 which connects the two tubes and removes coupling therebetween; power divider 2 which divides power into two branches and supplies to two segments of accelerating tubes respectively; a power controlling system which is comprised of attenuator 16 installed on a branch same as accelerating tube 7 and phase shifter 3; a rotatable target structure which is comprised of vacuum box 18 fixed on rotatable base 20, target 8 and X-ray window 19 installed within vacuum box 18, and a corrugated pipe which connects accelerating tube 7 and vacuum box 18. The two segments of accelerating tubes use a common pulse power source 1, but are supplied with power via power divider 2, respectively. The cascade of accelerating cavities is of a single-periodic structure. The accelerating cavities are coupled via magnetic coupling, and operate in a π mode. Direct-current high-voltage gun 5 injects electron beams into the combined accelerating tube in a negative angle injection manner. The energy of the electron beam bunches is continuously adjusted by adjusting continuously the microwave phase difference between two segments of the accelerating tubes by phase shifter 3. The electron beams outputted from the apparatus have a spot of a small root mean square radius, which can meet the requirement of medical imaging. The electron beam bunches can be adjusted in an energy range from 0.5 MeV to 2 MeV, which are applicable to medical imaging. The energy range can be adjusted by adjusting the attenuation amount of attenuator 16 on microwave power 9. The energy range also may be limited by limiting the phase shift of phase shifter 3. At the same time, the upper limit of the energy range can be enhanced by increasing the power of pulse power source 1. Accordingly, it is not limited to generation of electron beams within an energy range from 0.5 MeV to 2 MeV, and can generate electron beams with a higher energy level. A rotatable target structure is introduced so that X-rays of the maximal power can be outputted even if the electron beam bunches of different energies strike the target. The rotatable target structure is not limited to the case where electron beams within the range from 0.5 MeV to 2 MeV strike the target. It is applicable to a case where electron beams of higher energy strike the target after the target is replaced.

According to the foregoing embodiments, magnetic coupling is used between cavities of the two accelerating tubes instead of side coupling commonly used in a standing linear accelerator, which reduces the width of the accelerating tube. Furthermore, the accelerating tube is of a single-cycle structure so that the coupling cavity is not necessary. The wall of the cavity is thickened and thus the cavities are easy to manufacture. Furthermore, the two segments of accelerating tubes both operate in a π mode, and thus the accelerating efficiency is highest. At the same time, the number of cavities is small due to application of low-energy beams, and the mode spacing is large enough to secure stable operation of the accelerating system, while the accelerating system is more compact in the vertical direction. Furthermore, the accelerating tube uses an RF alternating phase focusing technique, which automatically and laterally focuses the electron beams by using microwave field in the accelerating tubes and thus the spot at the output of the accelerating system is sufficiently small (such as, having a root mean square radius of 0.5 mm), to secure a high imaging quality. At the same time, the focusing coil is needless, which further reduces the width of the accelerating tube.

Furthermore, in order to further enhance the power and quality of X-rays outputted from the apparatus, the structure of the target is redesigned by introducing a rotation mechanism of the target by using a corrugated pipe and a rotatable base, and thus X-rays of the maximal power can be outputted for electron beams of any energy.

Although in the foregoing embodiments a single pulse power source 1 is provided to supply pulse power signals, which are divided into a first pulse power signal and a second pulse power signal by power divider 2 to be supplied to accelerating tubes 6 and 7, two pulse power sources may be used to provide pulse power signals to accelerating tubes 6 and 7, respectively, in other embodiments.

Furthermore, although the attenuator and phase shifter are arranged at the same branch as the second pulse power signal in the above embodiment, they may be arranged at the same branch as the first pulse power signal in other embodiments. Optionally, the attenuator and phase shifter may be arranged at the branches of the first pulse power signal and of the second pulse power signal, respectively.

Further, in the above embodiments, the accelerated electron beams strike the target to generate X-rays. In other applications, the striking operation is not necessary, and the electron beams so generated may be used to implement other applications.

Further, in the above embodiments, a direct-current high-voltage electron gun is used to generate electron beams before acceleration. It is obvious to those skilled in the art that other electron guns are also applicable to generate electron beams, which depends on the real scenario and environments.

The foregoing detailed description has set forth various embodiments of the standing wave electron linear accelerating apparatus via the use of block diagrams, flowcharts, and/or examples. Insofar as such block diagrams, flowcharts, and/or examples contain one or more functions and/or operations, it will be understood by those skilled in the art that each function and/or operation within such examples may be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, may be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of those skilled in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Versatile Disk (DVD), a digital tape, a computer memory, etc.; and a transmission type medium such as a digital and/or an analog communication medium (e.g., a fiber optic cable, a waveguide, a wired communications link, a wireless communication link, etc.).

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A standing wave electron linear accelerating apparatus comprising:

an electron gun configured to generate electron beams;

a pulse power source configured to provide a primary pulse power signal;

a power divider coupled downstream from the pulse power source and configured to divide the primary pulse power signal outputted from the pulse power source into a first pulse power signal and a second pulse power signal;

a first accelerating tube arranged downstream from the electron gun, coupled to the power divider and configured to accelerate the electron beams with the first pulse power signal;

a second accelerating tube arranged downstream from the first accelerating tube, and configured to receive the second pulse power signal from the power divider and accelerate the electron beams with the second pulse power signal;

a phase shifter coupled to an output of the power divider and configured to continuously adjust a phase difference between the first pulse power signal and the second pulse power signal so as to generate accelerated electron beams with continuously adjustable energy at an output of the second accelerating tube; and a target arranged downstream from the second accelerating tube and configured to be hit by the accelerated electron beams to generate X-rays;

wherein the target is mounted on a rotatable base so that an angle of an incident direction of the accelerated electron beams with respect to a surface of the target varies with the energy of the electron beams;

wherein the target is mounted in a vacuum box that is fixed on the rotatable base, wherein the side of the vacuum box includes an X-ray window and the second accelerating tube is coupled to the vacuum box via a corrugated pipe.

2. The standing wave electron linear accelerating apparatus according to claim 1 further comprising:

an attenuator coupled to the phase shifter and configured to attenuate the first pulse power signal and/or the second pulse power signal.

3. The standing wave electron linear accelerating apparatus according to claim 1, wherein the phase shifter is configured to adjust the phase difference so that accelerating cavities of the first accelerating tube and the second accelerating tube each operate in an accelerating phase mode.

4. The standing wave electron linear accelerating apparatus according to claim 1, wherein the phase shifter is configured to adjust the phase difference so that an accelerating cavity of the first accelerating tube operates in an accelerating phase mode while an accelerating cavity of the second accelerating tube operates in a decelerating phase mode.

5. The standing wave electron linear accelerating apparatus according to claim 1, wherein the first accelerating tube and the second accelerating tube both operate in a $\pi$ mode.

6. The standing wave electron linear accelerating apparatus according to claim 1, further comprising:

a power coupler arranged between the first accelerating tube and the second accelerating tube and configured to supply power to the first accelerating tube and the second accelerating tube.

7. The standing wave electron linear accelerating apparatus according to claim 1, wherein the electron gun injects electrons into the first accelerating tube with a negative angle.

8. The standing wave electron linear accelerating apparatus according to claim 1, wherein the accelerated electron beams have energy within a range from 0.5 MeV to 2.00 MeV.

9. A standing wave electron linear accelerating apparatus comprising:

an electron gun configured to generate electron beams;

a first pulse power source configured to provide a first pulse power signal;

a second pulse power source configured to provide a second pulse power signal;

a first accelerating tube arranged downstream from the electron gun, coupled to the first pulse power source and configured to accelerate the electron beams with the first pulse power signal;

a second accelerating tube arranged downstream from the first accelerating tube, and configured to receive the second pulse power signal from the second pulse power source and accelerate the electron beams with the second pulse power signal;

a phase shifter coupled to an output of the first pulse power source and/or output of the second pulse power source and configured to continuously adjust a phase difference between the first pulse power signal and the second pulse power signal so as to generate accelerated electron beams with continuously adjustable energy at an output of the second accelerating tube; and a target arranged downstream from the second accelerating tube and configured to be hit by the accelerated electron beams to generate X-rays;

wherein the target is mounted on a rotatable base so that an angle of an incident direction of the accelerated electron beams with respect to a surface of the target varies with the energy of the electron beams;

wherein the target is mounted in a vacuum box that is fixed on the rotatable base, wherein the side of the vacuum box includes an X-ray window and the second accelerating tube is coupled to the vacuum box via a corrugated pipe.

10. The standing wave electron linear accelerating apparatus according to claim 9, further comprising:

an attenuator coupled to the phase shifter and configured to attenuate the first pulse power signal and/or the second pulse power signal.

11. The standing wave electron linear accelerating apparatus according to claim 9, wherein the phase shifter is configured to adjust the phase difference so that accelerating cavities of the first accelerating tube and the second accelerating tube each operate in an accelerating phase mode.

12. The standing wave electron linear accelerating apparatus according to claim 9, wherein the phase shifter is configured to adjust the phase difference so that an accelerating cavity of the first accelerating tube operates in an accelerating phase mode while an accelerating cavity of the second accelerating tube operates in a decelerating phase mode.

13. The standing wave electron linear accelerating apparatus according to claim 9, wherein the first accelerating tube and the second accelerating tube both operate in a $\pi$ mode.

14. The standing wave electron linear accelerating apparatus according to claim 9, further comprising:

a power coupler arranged between the first accelerating tube and the second accelerating tube and configured to supply power to the first accelerating tube and the second accelerating tube.

15. The standing wave electron linear accelerating apparatus according to claim 9, wherein the electron gun injects electrons into the first accelerating tube with a negative angle.

16. The standing wave electron linear accelerating apparatus according to claim 9, wherein the accelerated electron beams have energy within a range from 0.5 MeV to 2.00 MeV.

17. A method for use in a standing wave electron linear accelerating apparatus comprising steps of:

generating electron beams;

accelerating the electron beams with a first pulse power signal in a first accelerating tube;

accelerating the electron beams with a second pulse power signal in a second accelerating tube which is arranged downstream from the first accelerating tube;

continuously adjusting a phase difference between the first pulse power signal and the second pulse power signal so as to generate accelerated electron beams with continuously adjustable energy at an output of the second accelerating tube; and hitting a target arranged downstream from the second accelerating tube with the accelerated electron beams to generate X-rays, wherein the target is mounted on a rotatable base so that an angle of an incident direction of the accelerated electron beams with respect to a surface of the target varies with the energy of the electron beams, wherein the target is mounted in a vacuum box that is fixed on the rotatable base, wherein the side of the vacuum box includes an X-ray window and the second accelerating tube is coupled to the vacuum box via a corrugated pipe.

* * * * *